United States Patent [19]

Nagano

[11] Patent Number: 4,947,086

[45] Date of Patent: Aug. 7, 1990

[54] SYSTEM FOR LIGHTING FLUORESCENT LAMPS

[75] Inventor: Fumikazu Nagano, Yamatokoriyama, Japan

[73] Assignee: Sharp Kabushiki Kaisha, Osaka, Japan

[21] Appl. No.: 154,328

[22] Filed: Feb. 10, 1988

[30] Foreign Application Priority Data

Feb. 10, 1987 [JP] Japan ..... 62-29331

[51] Int. Cl.[5] ..... H05B 37/00

[52] U.S. Cl. ..... 315/251; 315/291; 315/DIG. 5; 315/DIG. 7; 315/219; 315/97; 315/98

[58] Field of Search ..... 315/94–108, 315/219, 291, 250, 251, DIG. 4, DIG. 5, DIG. 7, 271

[56] References Cited

U.S. PATENT DOCUMENTS

| | | | |
|---|---|---|---|
| 4,075,476 | 2/1978 | Pitel | 315/97 |
| 4,082,981 | 4/1978 | Morton et al. | 315/97 |
| 4,339,690 | 7/1982 | Regan et al. | 315/97 |
| 4,413,209 | 11/1983 | Roche | 315/101 |
| 4,661,745 | 4/1987 | Citino et al. | 315/107 |
| 4,663,566 | 5/1987 | Nagano | 315/105 |

*Primary Examiner*—Leo H. Boudreau
*Assistant Examiner*—Michael Razavi

[57] ABSTRACT

A system for lighting fluorescent lamps, includes a plurality of fluorescent lamps, a transformer for generating filament voltage and a starting voltage for the fluorescent lamps, a switching circuit for sequentially and periodically opening and closing a plurality of its contacts and a driving circuit for electrically biasing the transformer and the switching circuit. A starting voltage is sequentially applied to the fluorescent lamps which are each independently connected to one of the contacts so that the fluorescent lamps may be sequentially turned on.

8 Claims, 3 Drawing Sheets

SYSTEM FOR LIGHTING FLUORESCENT LAMPS

BACKGROUND OF THE INVENTION

1. Field of the Invention

The present invention relates to a system for sequentially lighting fluorescent lamps. This system can be preferably employed in a color printer, a color scanner or the like.

2. Description of the Prior Art

In an optical reader such as a color printer, a color scanner or the like, tricolor light sources are applied to an original document to be read, sequentially first in red, second in green and third in blue. In this event, the original document is normally moved relative to the light sources for the scanning thereof so that reflected light from the light sources may be read out by an image pickup means such as a CCD (charge coupled device) or the like. A plurality of fluorescent lamps each for independently emitting light in one of the aforementioned three colors are generally employed as the light sources.

FIG. 1 illustrates an electric circuit of one of the conventional lighting systems.

Red, green and blue fluorescent lamps 1, 2 and 3 respectively are connected at their respective filaments R0, G0 and B0 commonly to the first winding 4*a* of a power transformer 4. The other filaments R1, G1 and B1 of the fluorescent lamps 1, 2 and 3 are independently connected to the second winding 4*b*, to the third one 4*c* and to the fourth one 4*d* of the transformer 4, respectively. The primary winding 4*p* of the transformer 4 is connected to a driving circuit 5 through a line l1 so as to be electrically biased through the driving circuit 5.

The line l1 is also connected to three starting circuits 9, 10 and 11 through contacts S1 S2 and S3 of switching circuits 6, 7 and 8, respectively so as to be electrically biased by the starting circuits 9, 10 and 11. The switching circuits 6, 7 and 8 sequentially connect and disconnect the line l1 to the starting circuits 9, 10 and 11 under control of the driving circuit 5 through a line l2 every predetermined time. The switching circuits 6, 7 and 8 each comprise, for example, relays and the like.

In this circuit, a power switch S0 is initially turned on. When the driving circuit 5 has been electrically biased, the transformer 4 is charged with electric current therethrough. In this event, filament voltage V0 common to all the fluorescent lamps 1 to 3 is applied to the filaments R0, G0 and B0 thereof, whereas filament voltage V1, V2 and V3 are independently applied to the other filaments R1, G1 and B1 of the fluorescent lamps 1 to 3, respectively. As a result, the filaments of the red, green and blue fluorescent lamps 1, 2 and 3 respectively are heated and continue to be heated in use.

Upon lapse of a period required for preheating the filaments, the driving circuit 5 drives the switching circuits 6, 7 and 8 so that the first, second and third contacts S1, S2 and S3 may be sequentially and cyclically connected or disconnected. As a result, the first, second and third starting circuits 9, 10 and 11 are sequentially connected to the line l1 so that the first, second and third starting voltage V4, V5 and V6 are sequentially independently applied between both the filaments R0–R1 of the red fluorescent lamp 1, between those G0–G1 of the green fluorescent lamp 2 and between those B0–B1 of the blue fluorescent lamp 3 through current-limiting capacitors C1, C2 and C3, respectively. Consequently, the corresponding fluorescent lamps 1 to 3 are selectively turned on and off so that the scanning and readout of the original document may be conducted with the use of three different colors.

In the above described conventional system, however, it is necessary to independently provide three switching circuits 6, 7 and 8 for sequentially lighting the corresponding fluorescent lamps 1, 2 and 3. Since these appliances inevitably occupy considerable space in an apparatus employing therein the conventional system, such an apparatus has been manufactured undesirably at high cost. There has been, therefore, an increased demand for the system for lighting the fluorescent lamps which enables the apparatus to be of a small size at reduced production cost.

SUMMARY OF THE INVENTION

Accordingly, the present invention has been developed with a view to substantially eliminating the above described disadvantage inherent in the prior art system for lighting fluorescent lamps, and has for its essential object to provide an improved system for lighting the fluorescent lamps which enables small-sized apparatus at reduced production cost.

Another important object of the present invention is to provide a system of the above described type which is simple in construction and stable in functioning.

In accomplishing these and other objects, according to one preferred embodiment of the present invention, there is provided a system for lighting fluorescent lamps, which includes a plurality of fluorescent lamps, a transformer for generating filament voltage and starting voltage of the fluorescent lamps, a switching circuit for sequentially opening and closing a plurality of contacts provided therein every predetermined time, and a driving circuit for electrically biasing the transformer and the switching circuit. Each contact is independently connected to one of the fluorescent lamps.

In the system according to the present invention, the transformer and the switching circuit are electrically biased by a driving circuit. The filament voltage of the transformer heats the filaments of the fluorescent lamps, and the starting voltage is sequentially applied to the fluorescent lamps through the contacts every predetermined time. In this way, a plurality of fluorescent a different colored light source are sequentially turned on.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
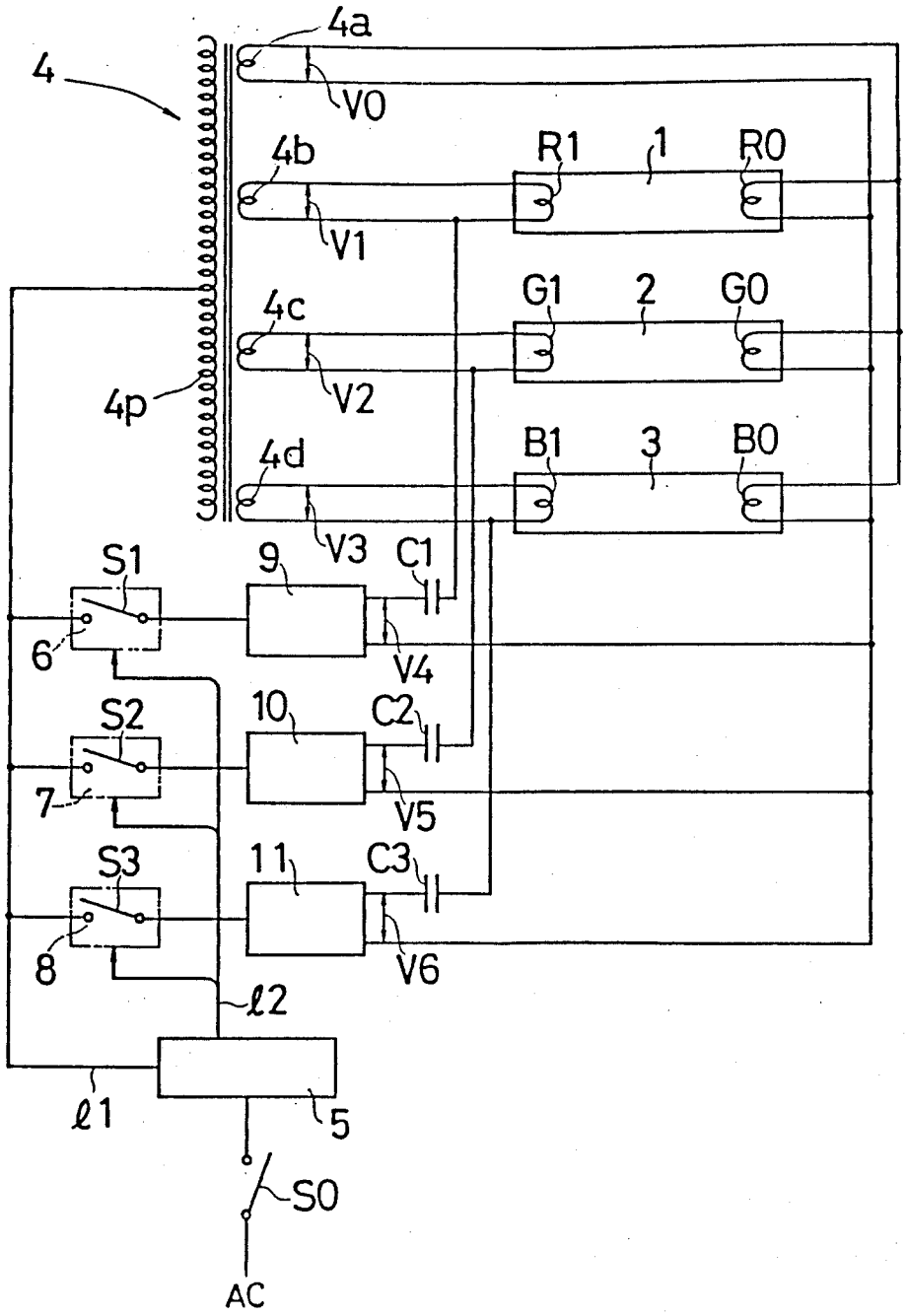
Fig. 1 PRIOR ART
FIG. 1 is an electric circuit employed in the conventional system for lighting fluorescent lamps.
Figure 2:
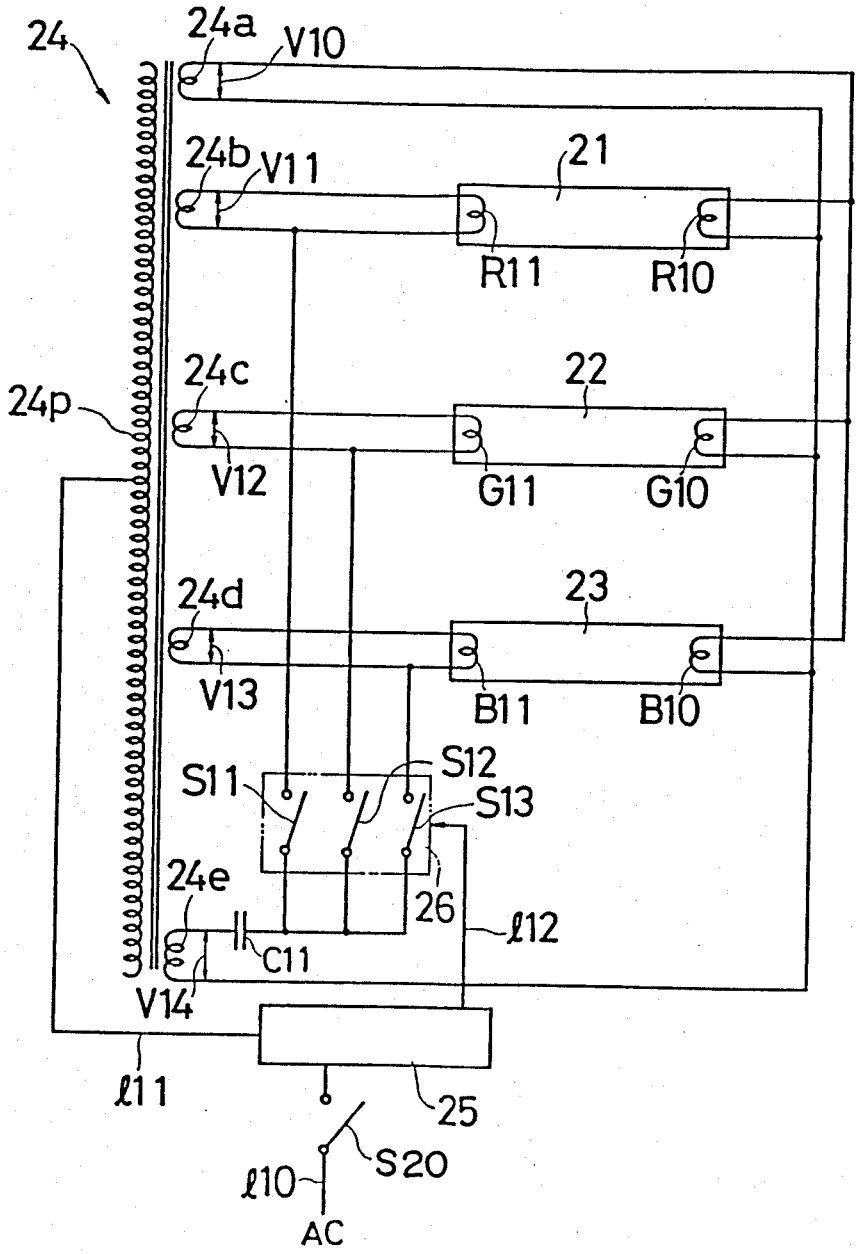
FIG. 2 is an electric circuit employed in the system for lighting the fluorescent lamps according to one preferred embodiment of the present invention.

FIG. 2 illustrates an electric circuit of a system for lighting fluorescent lamps according to one preferred embodiment of the present invention.

In this embodiment, a plurality of fluorescent lamps, i.e., red, green and blue fluorescent lamps 21, 22 and 23 respectively are provided as light sources. Filaments R10, G10 and B10 of the fluorescent lamps 21, 22 and 23 are commonly connected to the first winding 24*a* of a transformer 24 which generates filament voltage and starting voltage of the fluorescent lamps 21, 22 and 23. The other filaments R11, G11 and B11 of the fluorescent lamps 21, 22 and 23 are independently connected to the second, third and fourth winding 24*b*, 24*c* and 24*d* of the transformer 24, respectively.

The primary winding 24*p* of the transformer 24 is connected to a driving circuit 25 through a line l11 so as to be electrically biased by an output therefrom. The driving circuit 25 is also connected to a line l12 which is further connected to a switching circuit 26 comprising, for example, relays. The driving circuit 25 is further connected to a power switch S20 so as to be supplied with electric current through it and a line l10. The switching circuit 26 has a plurality of contacts S11, S12 and S13 for sequentially controlling electric connection and cut-off at desired timing described later under control of the driving circuit 25.

On the secondary side of the transformer 24, is further provided high-voltage winding 24*e* required for starting the fluorescent lamps. One terminal of the high-voltage winding 24*e* is connected to one common terminal of the filaments R10, G10 and B10 of the fluorescent lamps 21, 22 and 23, respectively, whereas the other terminal thereof is connected to one common terminal of the contacts S11, S12 and S13 of the switching circuit 26 through a current-limiting capacitor C11. The other terminal of each contact S11, S12 or S13 is independently connected to one terminal of each filament R11, G11 or B11, respectively.

Figure 3:
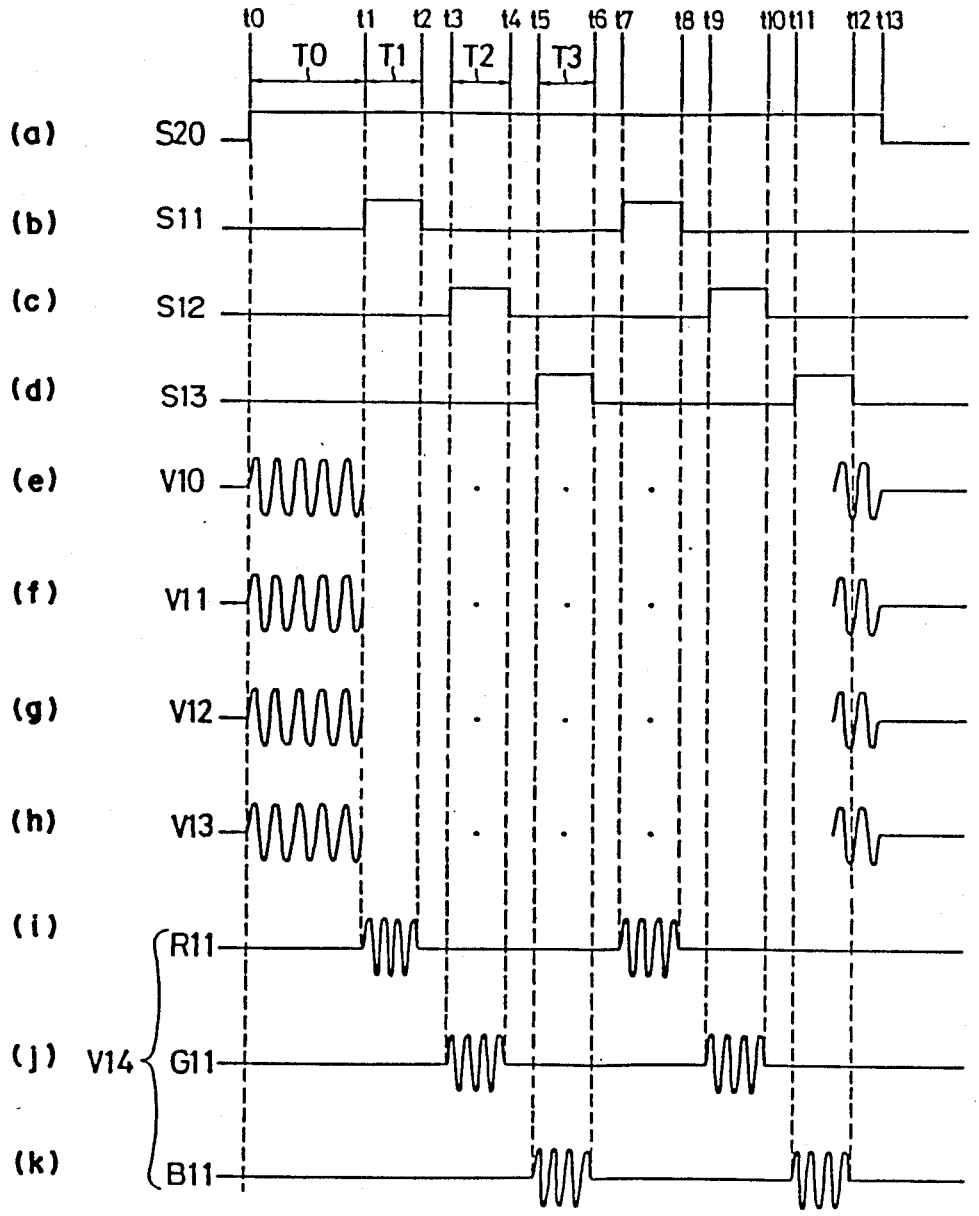
FIG. 3 is a time-chart showing the operation of the system of FIG. 2.

FIG. 3 is a time-chart showing the operation of the system of the present invention.

At the beginning of the operation, the power switch S20 is initially turned on at the time t0 in FIG. 3(*a*) so that the driving circuit 25 may be electrically biased. The transformer 24 is then electrically biased through the driving circuit 25. As shown in FIG. 3(*e*) to 3(*h*), the filament voltage V10 is applied commonly to the filaments R10, G10 and B10 of the fluorescent lamps 21, 22 and 23, respectively. The filament voltage V11, V12 and V13 are independently applied to the other filaments R11, G11 and B11 of the fluorescent lamps 21, 22 and 23, respectively. In this way, the filaments of the red, green and blue fluorescent lamps 21, 22 and 23 are heated. The filament voltage V10 to V13 are each, for example, 8V. Each filament is continuously heated as far as the time t13 during the use of the fluorescent lamps.

Upon lapse of a period T0 from the time t0 to t1 required for preheating the filaments, the switching circuit 26 is electrically biased by the driving circuit 25. In this event, as shown in FIGS. 3(*b*) to 3(*d*), the first, second and third contacts S11, S12 and S13 are sequentially charged with electric current for predetermined periods T1 from the time t1 to t2, T2 from the time from t3 to t4 and T3 from the time t5 to t6, respectively. Accordingly, as shown in FIGS. 3(*i*) to 3(*k*), the starting voltage V14 is sequentially independently applied, through the current-limiting capacitor C11, between the filaments R10 and R11, between those G10 and G11 and between those B10 and B11 of the red, green and blue fluorescent lamps 21, 22 and 23, respectively.

The starting voltage V14 is, for example, 300V, thereby to sequentially light the fluorescent lamps 21 to 23 at the aforementioned predetermined time. As a result, the fluorescent lamps 21 to 23 are applied to the paper sheet (not shown) so that the scanning and read-out thereof may be conducted with the use of three colors. The operation after the time t7 up to the completion time t13 is the same as above.

By the above described construction and operation of the present invention, it is not necessary to provide a plurality of starting circuits corresponding to respective fluorescent lamps, as is required in the conventional system. Accordingly, small-sized apparatus can be obtained desirably at reduced production cost.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A system for sequentially lighting a plurality of fluorescent lamps comprising:

filament voltage supply means for supplying a filament voltage to each said fluorescent lamps;

starting voltage supply means for developing a starting voltage sufficient to cause illumination of said fluorescent lamps;

a single switching circuit for sequentially and periodically connecting said starting voltage developed by said starting voltage supply means to said fluorescent lamps to cause the cyclic illumination thereof;

said starting voltage supply means including a transformer having a primary winding and a single starting voltage secondary winding connected to said single switching circuit so as to develop a starting voltage sufficient to cause illumination of said fluorescent lamps.

2. The system of claim 1 further comprising:

said transformer primary winding supplied with an energization voltage;

said filament voltage supply means including said transformer having said primary winding and a filament voltage secondary winding associated with each said fluorescent lamp to develop said filament voltage therefore.

3. The system of claim 2 wherein single starting voltage secondary winding is connected to said single switching circuit through a current limiting capacitor.

4. A system as claimed in claim 1, wherein said fluorescent lamps emit light in red, green and blue, respectively.

5. A system for sequentially lighting a plurality of fluorescent lamps comprising:

a plurality of fluorescent lamps;

a driving circuit supplying an energizing waveform;

a transformer generating a filament voltage and a starting voltage for each of said lamps;

said starting voltage, transformer including a primary and a single secondary winding of the transformer connected to a single switching circuit through a current limiting capacitor for periodically switching said starting voltage for illuminating said fluorescent lamps in sequence.

6. A system as claimed in claim 5, wherein said fluorescent lamps emit light in red, green and blue, respectively.

7. A system for lighting fluorescent lamps comprising:

a plurality of fluorescent lamps;

a transformer generating a filament voltage for each said lamp and a starting voltage at a single secondary winding for supply to all of said lamps, said single secondary winding operatively connected to a primary winding of the transformer and connected to a single switching circuit through a current limiting capacitor functioning for illuminating the fluorescent lamps in sequence;

a drive circuit supplying a bias voltage to said transformer, said switching circuit having a plurality of sequentially opening and closing contacts for supplying said starting voltage to each said fluorescent lamp in sequence, each said contact controlling the supply of said starting voltage to a single associated with fluorescent lamp.

8. A system as claimed in claim 7, wherein said fluorescent lamps emit light in red, green and blue, respectively.

* * * * *